US005966780A

United States Patent [19]

Gobbels

[11] Patent Number: 5,966,780

[45] Date of Patent: Oct. 19, 1999

[54] METHOD FOR MONITORING THE FILL STATE OF SLIVER CANS

[75] Inventor: Heinz-Dieter Gobbels, Monchengladbach, Germany

[73] Assignee: W. Schlafhorst AG & Co., Germany

[21] Appl. No.: 09/108,488

[22] Filed: Jul. 1, 1998

[30] Foreign Application Priority Data

Jul. 2, 1997 [DE] Germany ..... 197 28 202

[51] Int. Cl.[6] ..... D04H 11/00

[52] U.S. Cl. ..... 19/159 R; 19/0.25; 19/157; 19/159 A

[58] Field of Search ..... 19/159 A, 159 R, 19/157, 65 A, 0.25; 57/263, 281; 414/288; 324/644; 356/372

[56] References Cited

U.S. PATENT DOCUMENTS

| | | | |
|---|---|---|---|
| 4,021,795 | 5/1977 | Hollingsworth . | |
| 4,939,895 | 7/1990 | Raasch et al. | 57/263 |
| 4,982,563 | 1/1991 | Stahlecker | 19/159 A |
| 5,431,003 | 7/1995 | Raasch | 19/159 A |
| 5,509,261 | 4/1996 | Wassenhoven et al. | 57/263 |
| 5,664,398 | 9/1997 | Leifeld | 19/159 R |
| 5,673,461 | 10/1997 | Sramek | 19/159 R |

FOREIGN PATENT DOCUMENTS

| | | |
|---|---|---|
| 0 284 573 | 3/1988 | European Pat. Off. . |
| 0 459 956 A1 | 5/1991 | European Pat. Off. . |
| GM 18 59 997 | 7/1962 | Germany . |
| AS 15 10 471 | 11/1972 | Germany . |
| OS 25 54 915 | 6/1977 | Germany . |
| 36 14 654 A1 | 11/1987 | Germany . |
| 40 15 826 A1 | 2/1992 | Germany . |
| 196 54 375 A1 | 6/1997 | Germany . |
| 62-4178 | 1/1987 | Japan . |
| 3-166170 | 7/1991 | Japan . |

*Primary Examiner*—John J. Calvert
*Assistant Examiner*—Gary L. Welch
*Attorney, Agent, or Firm*—Kennedy Covington, Lobdell & Hickman, LLP

[57] ABSTRACT

A method for improving the monitoring of the fill state of a sliver can (5) at a spinning station of a textile machine processing sliver wherein a defined portion (24 or 124) of a can bottom (22) is initially kept free from sliver (6) while a predetermined amount of sliver (6) is deposited on an adjoining portion (25 or 125) of the can bottom (22) and only after the adjoining portion (25 or 125) is covered with sliver, is the defined portion (24 or 124) covered with sliver (6). The method includes monitoring the defined (24 or 124) portion while the sliver is being drawn out and detecting when the defined portion of the can bottom (22) is uncovered to trigger a signal for exchanging an empty can for a filled sliver can. In one preferred embodiment, a sensor (27) for monitoring the defined portion (24 or 124) and detecting an uncovered can bottom is mounted on a service unit (16) which passes over the spinning stations. In another preferred embodiment, a sensor (127) is mounted on a spinning station (2) and continuously monitors the fill state of the sliver can (5).

6 Claims, 3 Drawing Sheets

METHOD FOR MONITORING THE FILL STATE OF SLIVER CANS

FIELD OF THE INVENTION

The present invention relates generally to a method for improving the monitoring of the fill state of sliver cans of a textile machine for processing slivers.

BACKGROUND OF THE INVENTION

Sliver cans are known for receiving and dispensing sliver in connection with textile machines processing sliver. These textile machines typically include a plurality of spinning or work stations and a sliver can located at each spinning station. In operation, sliver is drawn from each sliver can into the spinning station and fed into a spinning unit. If a can containing sliver becomes empty at a work station of a textile machine processing slivers, the empty can is typically exchanged for a full can. While the empty can is being exchanged, there is a break in the production which results in a reduction of productivity. To minimize the downtimes of the textile machines, it is known to monitor the fill state of the sliver cans, so that when a sliver can becomes empty, the exchange of the empty can for a full can may be initiated. For example, it is known from German Patent Publication DE 36 14 654 A1, to utilize a sensor at the piecing carriage of a textile machine to monitor the fill state of the sliver cans at the individual spinning stations of an open-end spinning machine. The sensor is positioned on the underside of the piecing carriage and monitors the fill state of each sliver can in the course of the travel of the piecing carriage along the spinning machine, and reports the location of a completely empty sliver can to a control device on the machine, which then initiates the exchange of the empty can for a freshly filled one, or the filling of the empty can. One disadvantage of this method is that an indefinite period of time passes before an empty can is sensed by the sensor on the piecing carriage and the exchange or filling, of the can is initiated.

Different methods for monitoring the degree of filling of sliver cans are described in German Published, Non-Examined Patent Application DE-OS 25 54 915. In one method, an ultrasound transmitter/receiver unit, for example, is proposed for monitoring the fill level of the sliver. In this method, the monitoring stations are provided at each work station. When the fill level of each sliver can falls below a defined preset threshold value, the sliver can is exchanged. Although this method eliminates the time period between when a sliver can is emptied and when the sliver can is exchanged for a full can, a disadvantage is that the sliver can is exchanged while more than an inconsiderable amount of sliver remains in each sliver can. Thus, because the sliver can is exchanged before the sliver is depleted from the can, the amount of sliver which can be drawn from the can before it is exchanged is less than the full capacity of the can and the can is not fully utilized. Therefore, this method undesirably increases the number of times the sliver cans must be exchanged. In addition, this method requires the removal of the sliver remaining in each can after such can has been exchanged for a full sliver can.

OBJECT AND SUMMARY OF THE INVENTION

It is the object of the present invention to provide an improved method for monitoring the fill state of sliver cans of a textile machine for processing slivers over the methods of the state of the art described above and, in particular, overcoming the disadvantages thereof.

In accordance with the present invention, this object is attained by means of a simple method for detecting the fill state of sliver cans of a textile machine for processing slivers. The method basically comprises filling at least one sliver can having a can bottom which includes a first portion and an adjoining, second portion. The filling step includes initially depositing in layers a predetermined amount of the sliver on the second portion of the can bottom while keeping the first portion of the can bottom free of sliver. After the second portion is covered with the predetermined amount of sliver, the sliver is deposited on the first portion so that the first portion of the can bottom is covered with sliver. Once the can is filled with sliver, the filled sliver can is deposited at a work station of the textile machine processing and the first portion of the can bottom is monitored while the sliver is being drawn out of the sliver can for processing. When the sliver has been drawn out to the extent that the first portion is no longer covered with sliver, the uncovered can bottom is detected and triggers a signal for exchanging the sliver can at the work station.

The method in accordance with the present invention advantageously provides a simple method for the early detection of the depletion of sliver from a sliver can which allows an empty sliver can to be exchanged for a full sliver can without causing a break in production or increasing the number of can exchanges thereby providing a method which utilizes the full capacity of each sliver can and optimizes the process of exchanging cans. Because the method of the present invention provides that a defined portion of the can bottom is initially kept free of sliver while a predetermined amount of sliver is deposited on and covers the adjoining portion of the can bottom, there is sufficient time, after the uncovered can bottom is registered by a sensor, before the sliver can is completely empty, to initiate a can exchange without the work station being stopped and, no or only a minimal remnant of sliver waste remains in the can so that only a small amount of sliver waste occurs.

In order to be able to monitor the fill level of sliver remaining in the sliver can in accordance with the present invention, it is necessary to orient each of the sliver cans at the can filling station in such a way that the deposit of the sliver starts in the same area of the can bottom of each sliver can. The orientation of the cans depends on the location where the sensor is arranged or positioned and which area of the sliver cans will be monitored by the sensor.

Preferably, the amount of sliver, which is initially deposited exclusively on the defined portion of the can bottom, is advantageously calculated in coordination with the draw-in speed of the sliver by the textile machine in such a way, that the calculated amount of sliver is at least sufficient for the period of time required for exchanging an empty sliver can for a filled sliver can. In addition, the period of time required for a can exchange can be affected by whether the monitoring sensor is arranged or positioned directly at a spinning station or, alternately, positioned on a service unit, which patrols along the individual spinning stations and, for example, fixes yarn breaks and exchanges finished bobbins for empty tubes. If the monitoring sensor is positioned at the spinning station, it is necessary to match the amount of the initially deposited sliver to the average length of time required for a can exchange. However, if the monitoring sensor is positioned on the service unit, it is also necessary to consider the average length of time which passes between successive visits by the service unit to a spinning station, and therefore to a sliver can. While monitoring the fill state of sliver cans at each spinning station may require elaborate devices, it provides the assurance that a can exchange takes place within the shortest possible time, without leaving a sliver remnant in the can being replaced and without stopping the spinning station because of the wait for a fresh can. Alternately, arranging the monitoring sensor on a patrolling service unit is suitable, for example, for retroactively equipping a spinning machine for the method in accordance with the present invention, provided the service unit recognizes its position at a spinning station.

Further details, features and advantages of the present invention will be understood from an exemplary embodiment described below with reference to the accompanying drawings.

DETAILED DESCRIPTION OF THE EXEMPLARY EMBODIMENTS

Figure 1:
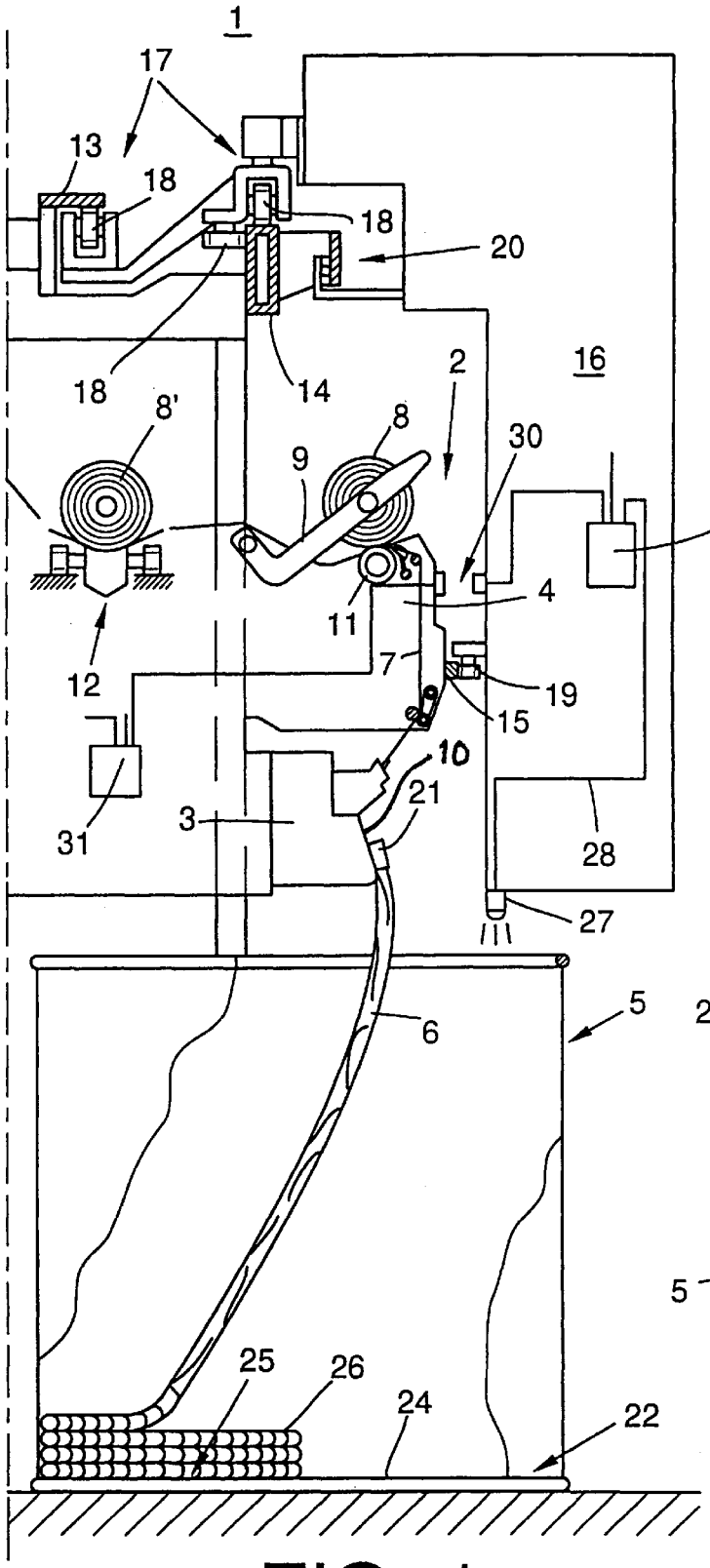
FIG. 1 is a side elevation partially in cross-section of a service unit positioned at a spinning station of a spinning machine with a sliver can from which sliver is being drawn, and having a sensor for checking the fill state of the sliver can.
Figure 2:
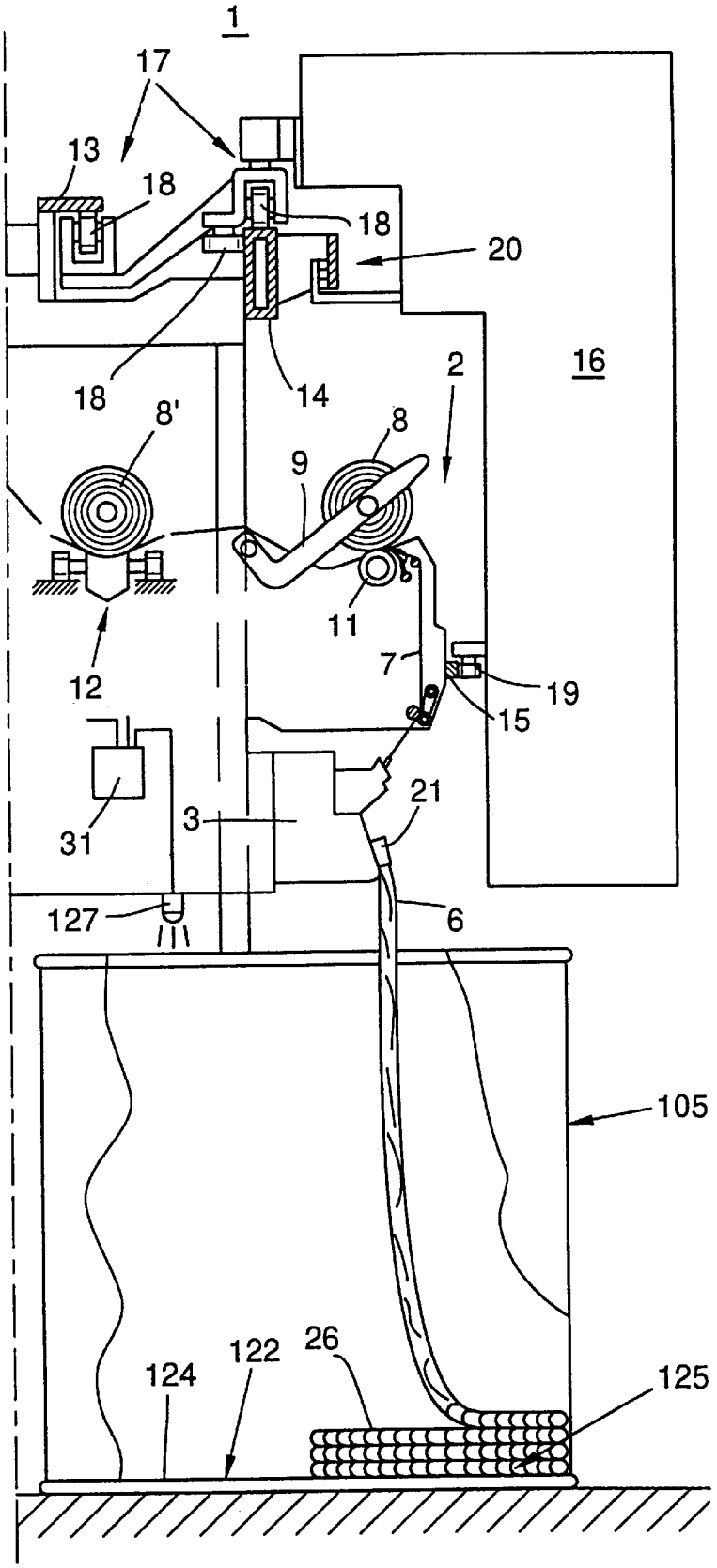
FIG. 2 is a side elevation partially in cross-section of a spinning station of a spinning machine having a sensor positioned on the spinning station for monitoring the fill state of the sliver can.

Referring now to the accompanying drawings and initially to FIG. 1, a known form of a spinning station is identified generally at 2 in an open-end spinning machine identified as a whole by 1. As shown, a spinning station 2 is equipped with a spinning unit 3 and a winding device 4. The sliver 6, which has been placed into a spinning or sliver can 5, is spun into a yarn 7 in the spinning unit 3 and is subsequently wound into cheeses 8 on the winding device 4. The sliver 6 is pulled into the opening 10 via a compressor by means of a draw-in arrangement 21 and is opened into individual fibers, which are fed into the spinning unit 3. As shown in FIGS. 1 and 2, each winding device 4 is equipped with a bobbin frame 9 for the rotatable support of an empty tube, or respectively a cheese 8 and a winding drum 11 for driving the cheese, or respectively the empty tube, by frictional contact. The open-end spinning machine 1 of the present invention also includes a circulating tube and bobbin transport device 12, for providing the individual spinning station with empty tubes, or for transporting the finished cheeses 8' away.

As shown in FIGS. 1 and 2, a service unit 16 is movably arranged on the spinning machine 1 on guide rails 13 and 14 and a support rail 15. A running gear 17 of the service unit 16 has rollers 18 and a support wheel 19. The supply of electrical energy to the service unit 16 is provided by, such as by way of example, a wiper contact device 20 as shown in FIGS. 1 and 2. In operation, at least one service unit 16 continuously patrols along the spinning stations 2 of the open-end spinning machine 1. If a yarn break has occurred at a spinning station 2, or when a cheese at one of the spinning stations has reached its prescribed diameter and needs to be exchanged for an empty tube, the service unit 16 is positioned in front of this spinning station 2 and repairs the yarn break, or respectively changes the cheese 8. The work units required for piecing the yarn, cleaning the spinning unit and changing the cheeses are known from the prior art and are not a subject of the present invention. Accordingly, the work units are not shown in FIGS. 1 and 2 for the sake of simplicity and improved clarity of the drawings. Because the service unit 16 continuously patrols along the spinning stations 2 and in the process passes over the sliver cans 5 parked at the spinning stations, it is suitable for monitoring the fill state of the sliver in the cans.

Figure 1A:
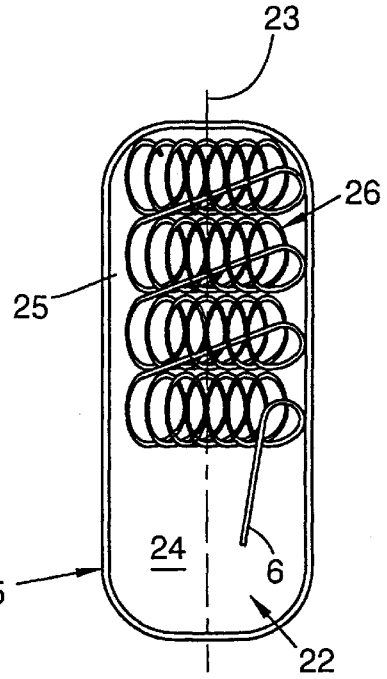
FIG. 1*a* is a top view of a sliver can showing one portion of the can bottom covered with sliver and an adjoining portion which is no longer covered with sliver.

In the first preferred embodiment, a substantially rectangular sliver can 5 is located at each spinning station 2 of the spinning machine 1. As known from the prior art, these cans essentially have a rectangular cross section. Because of their elongated shape, rectangular cans are particularly suited for the method in accordance with the present invention. Each sliver can 5 has a bottom 22 that can be easily divided into two areas or a first portion 24 and a second portion 25. As best seen in FIG. 1*a*, the first portion 24 and second portion 25 are located one behind the other in the longitudinal direction 23 of the sliver can 5. Referring now specifically to FIG. 1, the first portion 24 is located below the patrolling service unit 16 and is no longer covered by sliver 6, while in the second portion 25 below the spinning station 2, the last three layers 26 of the sliver 6 are being drawn into the spinning unit 3.

In the first preferred embodiment, the service unit 16 is equipped with a sensor 27, such as, by way of example, an optical sensor, which monitors the fill state of the sliver 6 in the sliver can 5 at each work station 2. The textile machine of the present invention will preferably include a plurality of at least two, work stations processing sliver. The sensor 27 of the second preferred embodiment detects when the first portion 24 of the can bottom 22 is no longer covered with sliver 6 on the basis of the color difference between the sliver 6 and the can bottom 22. The detection of the uncovered first portion 24 of the can bottom 22 is reported to a control device 29 of the service unit 16 via a signal line 28. The location and the fill state of the can 5 are reported to the control device 29 by means of bidirectional data exchange between the control device 29 of the service unit 16 and a control device 31 of the spinning station 2 or a central control device of the machine. Thereupon, the control device 31 causes a can filled with sliver to be brought in, as well as initiating the exchange of the empty can 5 for the filled can.

In order to ensure that sensor 27 is directed toward and maintains the same area or the first portion 24 of the can bottom 22 in its field of view, it is necessary that at a can filling station (see FIG. 3) the sliver can 5 be oriented so that the deposition of the sliver 6 starts in the same area or the second portion 25 of the can bottom 22 of each sliver can 5. In accordance with the first preferred embodiment illustrated in FIG. 1, the second portion 25 is preferably positioned under the spinning station 2 so that the first portion 24 is at a predetermined position relative to the work station during the course of a can exchange, and the first portion 24 of each sliver can, which is monitored by the service unit 16, is emptied first.

A second preferred embodiment of the present invention is illustrated in FIG. 2. In the second preferred embodiment, a sensor 127 for monitoring the fill state of a sliver can 105 is provided at each spinning station 2. The sensor 127 is arranged underneath the spinning station 2 and therefore continuously monitors the sliver can 105.

Because of the arrangement of the sensor 127 underneath the spinning station 2 there is a necessity of positioning the filled sliver can 105 underneath the spinning station in a predetermined position relative to the work station such that the area 124 of the can bottom 122, which was not covered with sliver when the filling of the can with sliver was started, is positioned in the field of view of the sensor 127. When the can becomes empty, first this area 124 will run out, as can be seen in FIG. 2, while the area 125 of the can bottom 122 located behind it is still covered with layers 26 of sliver 6.

Both in connection with the first and second preferred embodiments, the amount of sliver 6 deposited in the second portion 25, or respectively area 125, of the can bottom 22, or respectively 122, is of such a length that, starting with the time in which the sensor 27, or respectively 127, detects or registers the uncovered can bottom 24, or respectively 124, there is a period of time which passes before the sliver 6 is completely used up, which is sufficient for exchanging the empty can for a filled can, even with a can position which is most unsatisfactory in respect to the transport path.

Figure 3:
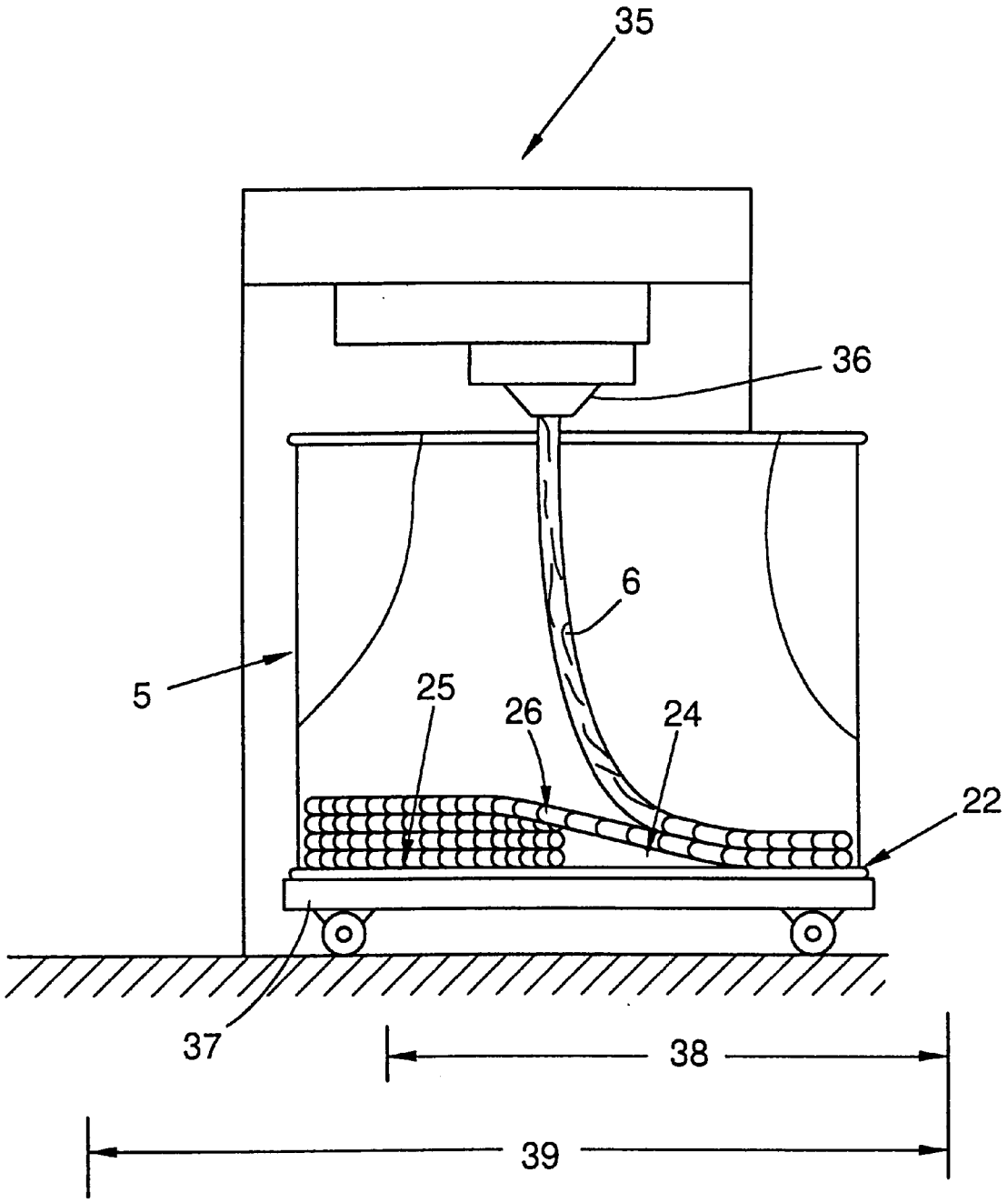
FIG. 3 is a side elevation partially in cross-section of a sliver can at a filling station illustrating the can being filled with sliver.

FIG. 3 illustrates a can filling station 35 where the sliver can 5, corresponding to the first preferred embodiment in FIG. 1, is filled with sliver 6 by a coiler 36. The sliver can 5 is standing on a traversing device, here indicated by a carriage 37. As indicated by a two-headed arrow 38, only the second portion 25 underneath the coiler 36 moves back and forth at the start of the sliver deposition on the can bottom 22 while a predetermined number of layers 26 of the sliver 6 is deposited on the second portion 25 and the first portion 24 is kept free of sliver. Only after the predetermined number of layers 26 has been deposited on the second portion 25, is the first portion 24 covered with sliver as shown in FIG. 3. Starting at this time, the sliver can 5 moves back and forth over its entire length under the coiler 36, as indicated by the two-headed arrow 39.

In order to determine or calculate the amount of sliver 6 and number of layers 26 to be initially deposited on only the second portion 25 or 125, the speed at which the sliver 6 is being drawn from the sliver can 5 is determined. The amount of sliver 6 is thus calculated in coordination with the draw-in speed of the sliver 6 by the spinning station 2 in such a way, that the calculated amount of sliver 6 is at least sufficient for the period of time required for exchanging an empty sliver can for a filled sliver can. In the first preferred embodiment, it is necessary to match the amount of the initially deposited sliver 6 on the second portion 25 to the average length of time required for a can exchange and to consider the average length of time which passes between successive visits by the service unit 16 to the spinning station 2. In the second preferred embodiment, the amount of the initially deposited sliver 6 on the second portion 125 will be calculated based on the average length of time required to exchange an empty sliver can for a filled can.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for detecting the fill state of sliver cans of a textile machine for processing slivers, comprising:

filling at least one sliver can having a can bottom including a first portion and an adjoining, second portion, the filling step further comprising:

initially depositing in layers a predetermined amount of the sliver, including at least two layers of the sliver, on the second portion of the can bottom while keeping the first portion of the can bottom free of sliver;

depositing the sliver on the first portion and covering the first portion of the can bottom after the second portion is covered with the predetermined amount of sliver;

depositing the filled sliver can at a work station of the textile machine for processing the sliver; and monitoring the first portion of the can bottom at the work station.

2. The method according to claim 1, wherein the monitoring of the first portion further comprises:

detecting the first portion of the can bottom when the first portion is no longer covered by sliver and then triggering a signal for exchanging the sliver can at the work station.

3. The method according to claim 1, wherein the filling of at least one sliver can further comprises:

orienting the sliver can at a can filling station for depositing the sliver on the second portion of the can bottom; and wherein depositing the filled sliver can at the work station further comprises positioning the filled sliver can at the work station so that the first portion is at a predetermined position relative to the work station.

4. The method according to claim 1, wherein depositing the predetermined amount of sliver in the second portion further comprises:

determining the speed at which the sliver is drawn from the sliver can by the textile machine processing the sliver; and wherein the predetermined amount of sliver deposited in the second portion is an amount sufficient for allowing the sliver can to be exchanged in at least an average amount of time based on the drawing speed of the sliver from the sliver can.

5. The method according to claim 1, wherein the textile machine processing the sliver includes at least two work stations and the monitoring of the first portion of the can bottom comprises:

utilizing a service unit which patrols the work stations of the textile machine; and providing a sensor on the service unit for monitoring the first portion of the can bottom.

6. The method according to claim 1, wherein the monitoring of the first portion of the can bottom comprises providing a sensor at the work station for monitoring the first portion of the can bottom.

* * * * *